US011120733B2

(12) United States Patent
Hashimoto

(10) Patent No.: US 11,120,733 B2
(45) Date of Patent: Sep. 14, 2021

(54) DISPLAY DEVICE SWITCHED TO DIFFERENT DRIVING MODES ACCORDING TO GRAY LEVEL

(71) Applicant: InnoLux Corporation, Miao-Li County (TW)

(72) Inventor: Kazuyuki Hashimoto, Miao-Li County (TW)

(73) Assignee: InnoLux Corporation, Miao-Li County (TW)

( * ) Notice: Subject to any disclaimer, the term of this patent is extended or adjusted under 35 U.S.C. 154(b) by 0 days.

(21) Appl. No.: 16/747,463

(22) Filed: Jan. 20, 2020

(65) Prior Publication Data

US 2020/0365074 A1 Nov. 19, 2020

Related U.S. Application Data

(60) Provisional application No. 62/849,164, filed on May 17, 2019.

(51) Int. Cl.
*G09G 3/30* (2006.01)
*G09G 3/32* (2016.01)

(52) U.S. Cl.
CPC ..... *G09G 3/32* (2013.01); *G09G 2300/043* (2013.01); *G09G 2310/027* (2013.01)

(58) Field of Classification Search
CPC ..... G09G 3/30–3291
See application file for complete search history.

(56) References Cited

U.S. PATENT DOCUMENTS

2006/0156121 A1* 7/2006 Chung ..... G09G 3/3233 714/726
2014/0198091 A1* 7/2014 Shin ..... G09G 3/3266 345/212
2016/0093251 A1* 3/2016 Chung ..... G01J 1/0403 345/207
2020/0111418 A1* 4/2020 Nam ..... G09G 3/3233

FOREIGN PATENT DOCUMENTS

CN 107993612 A 5/2018
CN 109389947 A 2/2019

* cited by examiner

*Primary Examiner* — Roy P Rabindranath
(74) *Attorney, Agent, or Firm* — Winston Hsu

(57) ABSTRACT

A display device includes a plurality of pixels. Each pixel includes a light emitting unit and a driving circuit. The driving circuit drives the light emitting unit in a pulse width modulation mode to present a first gray level lower than or equal to a predetermined gray level, and drives the light emitting unit in a current mode to present a second gray level higher than the predetermined gray level.

18 Claims, 9 Drawing Sheets

DISPLAY DEVICE SWITCHED TO DIFFERENT DRIVING MODES ACCORDING TO GRAY LEVEL

CROSS REFERENCE TO RELATED APPLICATION

This non-provisional application claims priority of U.S. provisional application No. 62/849,164, filed on May 17, 2019, included herein by reference in its entirety.

BACKGROUND OF THE DISCLOSURE

1. Field of the Disclosure

The present disclosure is related to a display device, and more particularly to a display device having a pulse width modulation mode and a current mode.

2. Description of the Prior Art

Electronic devices, such as display devices, have become indispensable necessities to modern people no matter in their work, study or entertainment. With a flourishing development of the portable electronic devices, the consumers not only pursue better electronic characteristics such as higher display quality, higher speed of response, longer life span or higher reliability, but also have higher expects on the functions or the stability of the products to be more diversified.

SUMMARY OF THE DISCLOSURE

One embodiment of the present disclosure discloses a display device. The display device includes a plurality of pixels. Each pixel includes a light emitting unit and a driving circuit.

The driving circuit drives the light emitting unit in a pulse width modulation mode to present a first gray level lower than or equal to a predetermined gray level, and drives the light emitting unit in a current mode to present a second gray level higher than the predetermined gray level.

These and other objectives of the present disclosure will no doubt become obvious to those of ordinary skill in the art after reading the following detailed description of the embodiment that is illustrated in the various figures and drawings.

DETAILED DESCRIPTION

Figure 1:
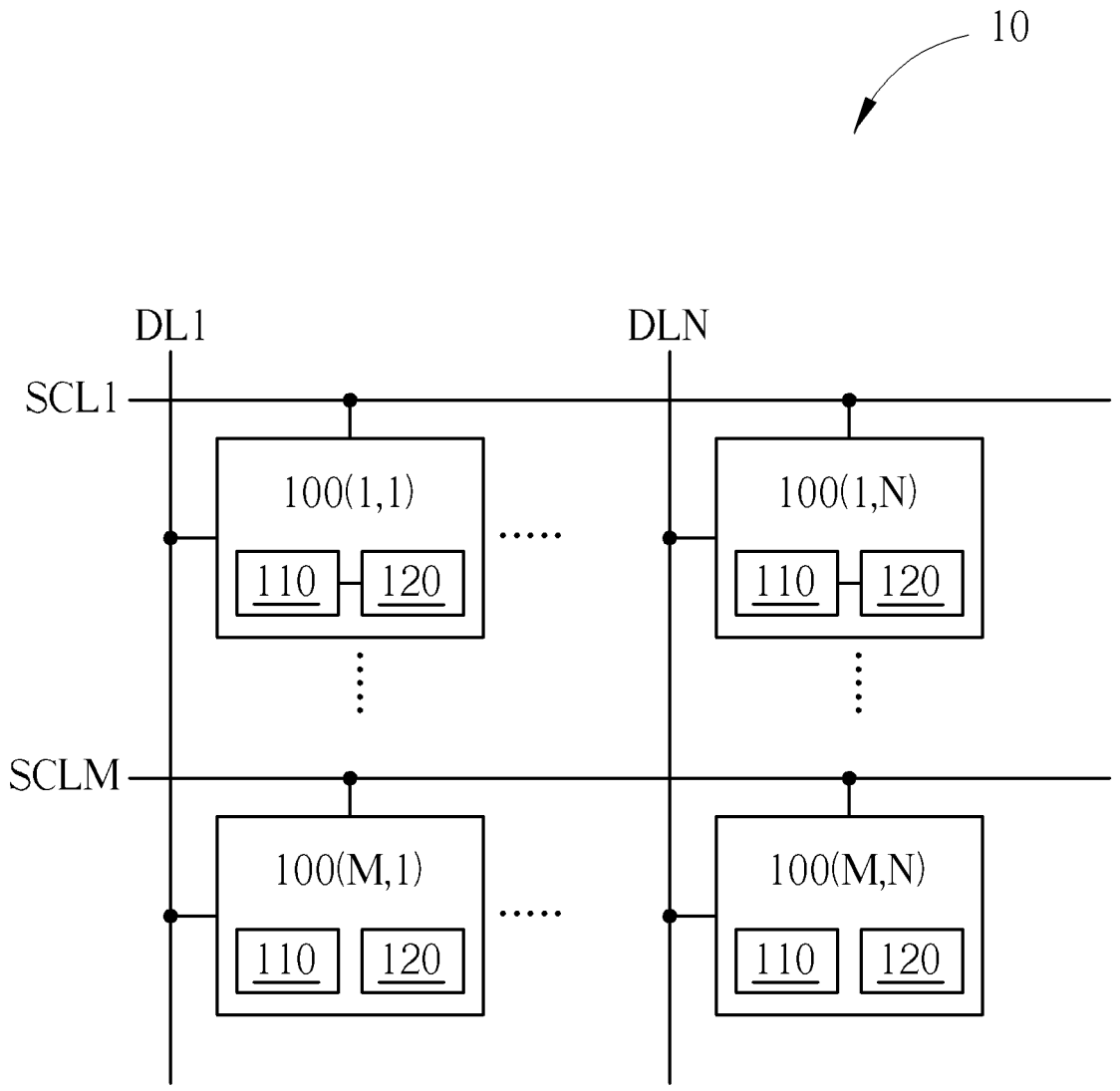
FIG. 1 shows a display device according to one embodiment of the present disclosure.

This description is made for the purpose of illustrating the general principles of the disclosure and should not be taken in a limiting sense.

The term "substantially" as used herein are inclusive of the stated value and means within an acceptable range of deviation for the particular value as determined by one of ordinary skill in the art, considering the measurement in question and the error associated with measurement of the particular quantity (i.e., the limitations of the measurement system). For example, "substantially" can mean within one or more standard deviations, or within ±20%, ±15%, ±10%, ±5%, ±3% of the stated value. It is noted that the term "same" may also refer to "about" because of the process deviation or the process fluctuation.

It should be understood that the following disclosure provides many different embodiments, or examples, for implementing different features of the application. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact.

FIG. 1 shows a display device 10 according to one embodiment of the present disclosure. The display device 10 includes a plurality of pixels 100(1,1) to 100(M,N), wherein M≥2 and N≥2, but not limited thereto.

At least one of the pixel 100(1,1) to 100(M,N) can be coupled to a corresponding scan line of the scan line SCL1 to the scan line SCLM, and a corresponding data line of the data line DL1 to the data line DLN. Also, at least one of the pixels 100(1,1) to 100(M,N) can include a light emitting unit 110 and a driving circuit 120. The following may take the pixel 100(1,1) as an example, and the examples of the pixel 100(1,1) may be applied to at least one of other pixels. The light emitting unit 110 can be a light emitting diode (LED), an organic light emitting diode (OLED), an inorganic light emitting diode, a mini-meter-sized LED (mini-LED), a micro-meter-sized LED(micro-LED), or a quantum dot.

In some embodiments, the driving circuit 120 can drive the light emitting unit 110 to emit light in a current mode or a pulse width modulation (PWM) mode. In the current mode, the intensity of the driving current may be determined according to the gray level to be presented. That is, to present a gray level of higher brightness, the driving circuit 120 may generate a driving current with higher intensity. However, to reduce the color shift caused by low driving current used for gray levels of lower brightness, the driving circuit 120 can be switched to the PWM mode when presenting the gray levels of low brightness. In the PWM mode, instead of generating a driving current with low intensity, the driving circuit 120 can generate a driving current with proper intensity and control the brightness by modulating the duty ratio of the driving current.

That is, the driving circuit 120 can drive the light emitting unit 110 in a PWM mode to present a gray level lower than or equal to a predetermined gray level to reduce color shift. Also, the driving circuit 120 can drive the light emitting unit 110 in a current mode to present a gray level higher than the predetermined gray level with a better efficiency.

Figure 2:
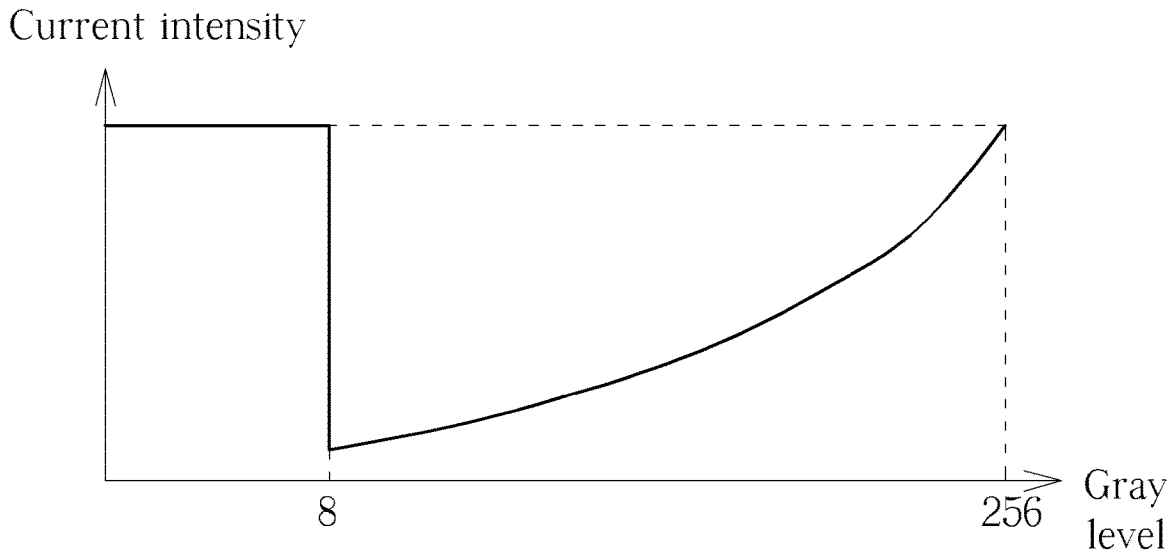
FIG. 2 shows the relation between the intensity of the driving current and the gray level to be represented.
Figure 3:
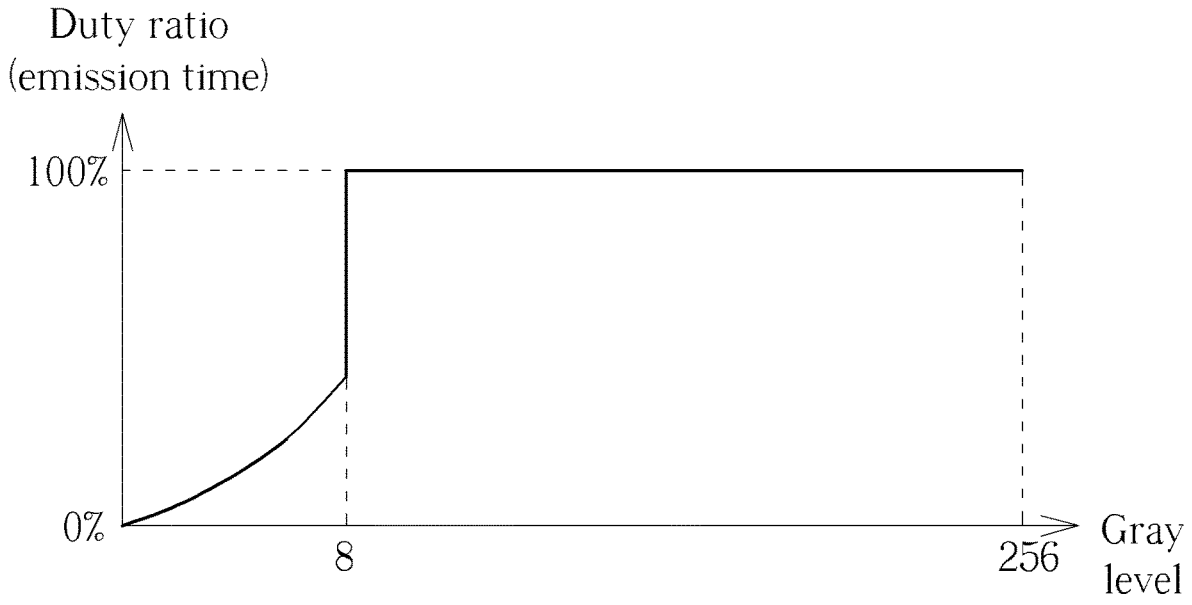
FIG. 3 shows the relation between the duty ratio of the driving current and the gray level to be presented.

FIG. 2 shows the relation between the intensity of the driving current and the gray level to be represented, and FIG. 3 shows the relation between the duty ratio of the driving current and the gray level to be presented. For example but not limited to, if the pixels 100(1,1) to 100(M,N) are designated to present 256 gray levels, then the predetermined gray level can be the $8^{th}$ gray level. That is, the driving circuit 120 would be in the current mode when driving the light emitting unit 110 to present the $9^{th}$ to $256^{th}$ gray levels, and the driving circuit 120 would be in the PWM mode when driving the light emitting unit 110 to present the $1^{st}$ to $8^{th}$ gray levels. The embodiment uses the $8^{th}$ gray level as the predetermined gray level, and a person having ordinary skill in the art would realize that the predetermined gray level may be another gray level. In some embodiments, the predetermined gray level may be $N^{th}$ gray level, and N may be ranged from 3 to 64 ($3 \geq N \geq 64$), such as 4, 6, 10, 16, 24, 32, 40, 50, or 60, but not limited thereto.

Therefore, in FIG. 2, the driving current can be fixed to a proper level when representing the $1^{st}$ to $8^{th}$ gray levels, and the driving current can increase with gray levels from low intensity to high intensity when representing the $9^{th}$ to $256^{th}$ gray levels. Also, in FIG. 3, the duty ratio of the driving current can increase with gray levels when representing the $1^{st}$ to $8^{th}$ gray levels, and the duty ratio of the driving current can be fixed when representing the $9^{th}$ to $256^{th}$ gray levels.

Also, in some embodiments, in the current mode, the duty ratio of the driving current can be adjusted according to the system requirement. For example, the driving current generated by the driving circuit 120 may have a duty ratio less than 100%. Furthermore, in the PWM mode, the driving current may also have different intensities when presenting different gray levels according to the system requirement. That is, the light emitting unit 110 may also be driven with a variable driving circuit in the PWM mode.

Figure 4:
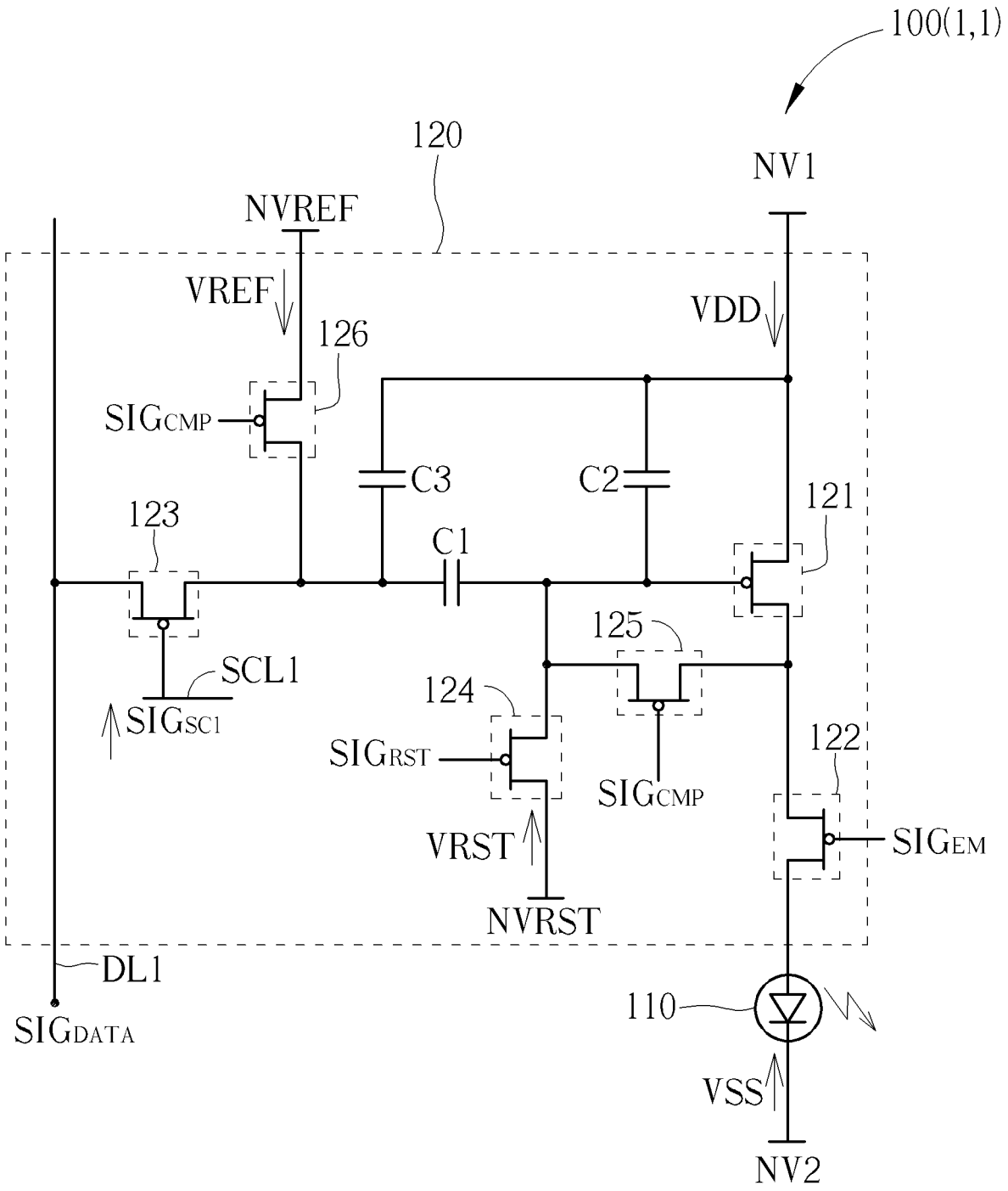
FIG. 4 shows the pixel in FIG. 1 according to one embodiment of the present disclosure.

FIG. 4 shows the pixel 100(1,1) according to one embodiment of the present disclosure. In FIG. 4, the driving circuit 120 may include a driving thin film transistor (TFT) 121, an emission control TFT 122, a scanning TFT 123, a reset TFT 124, a compensation TFT 125, a compensation TFT 126, a capacitor C1, a capacitor C2, and a capacitor C3. In some examples, the thin film transistor described above may be replaced by other types of switches with the same or similar function(s) and/or connection(s), but not limited thereto.

The driving TFT 121 has a first terminal coupled to a first voltage terminal NV1 for receiving a first voltage VDD, a second terminal, and a control terminal. The emission control TFT 122 has a first terminal coupled to the second terminal of the driving TFT 121, a second terminal coupled to the light emitting unit 110, and a control terminal for receiving an emission control signal $SIG_{EM}$. The light emitting unit 110 has a first terminal, e.g., an anode, coupled to the second terminal of the emission control TFT 122, and a second terminal, e.g., a cathode, coupled to a second voltage terminal NV2 for receiving a second voltage VSS.

The capacitor C1 has a first terminal coupled to the control terminal of the driving TFT 121, and a second terminal. The scanning TFT 123 has a first terminal coupled to a data line DL1, a second terminal coupled to the second terminal of the capacitor C1, and a control terminal for receiving a scan signal $SIG_{SC1}$ from the scan line SCL1. The capacitor C2 has a first terminal coupled to the first terminal of the driving TFT 121, and a second terminal coupled to the control terminal of the driving TFT 121. The capacitor C3 has a first terminal coupled to the first terminal of the driving TFT 121, and a second terminal coupled to the second terminal of the capacitor C1.

Also, the reset TFT 124 has a first terminal coupled to the control terminal of the driving TFT 121, a second terminal coupled to a reset voltage terminal NVRST for receiving a reset voltage VRST, and a control terminal for receiving a reset signal $SIG_{RST}$. The compensation TFT 125 has a first terminal coupled to the first terminal of the reset TFT 124, a second terminal coupled to the second terminal of the driving TFT 121, and a control terminal for receiving a compensation signal $SIG_{CMP}$. The compensation TFT 126 has a first terminal coupled to the second terminal of the capacitor C1, a second terminal coupled to a reference voltage terminal NVREF for receiving a reference voltage VREF, and a control terminal for receiving the compensation signal $SIG_{CMP}$.

Figure 5:
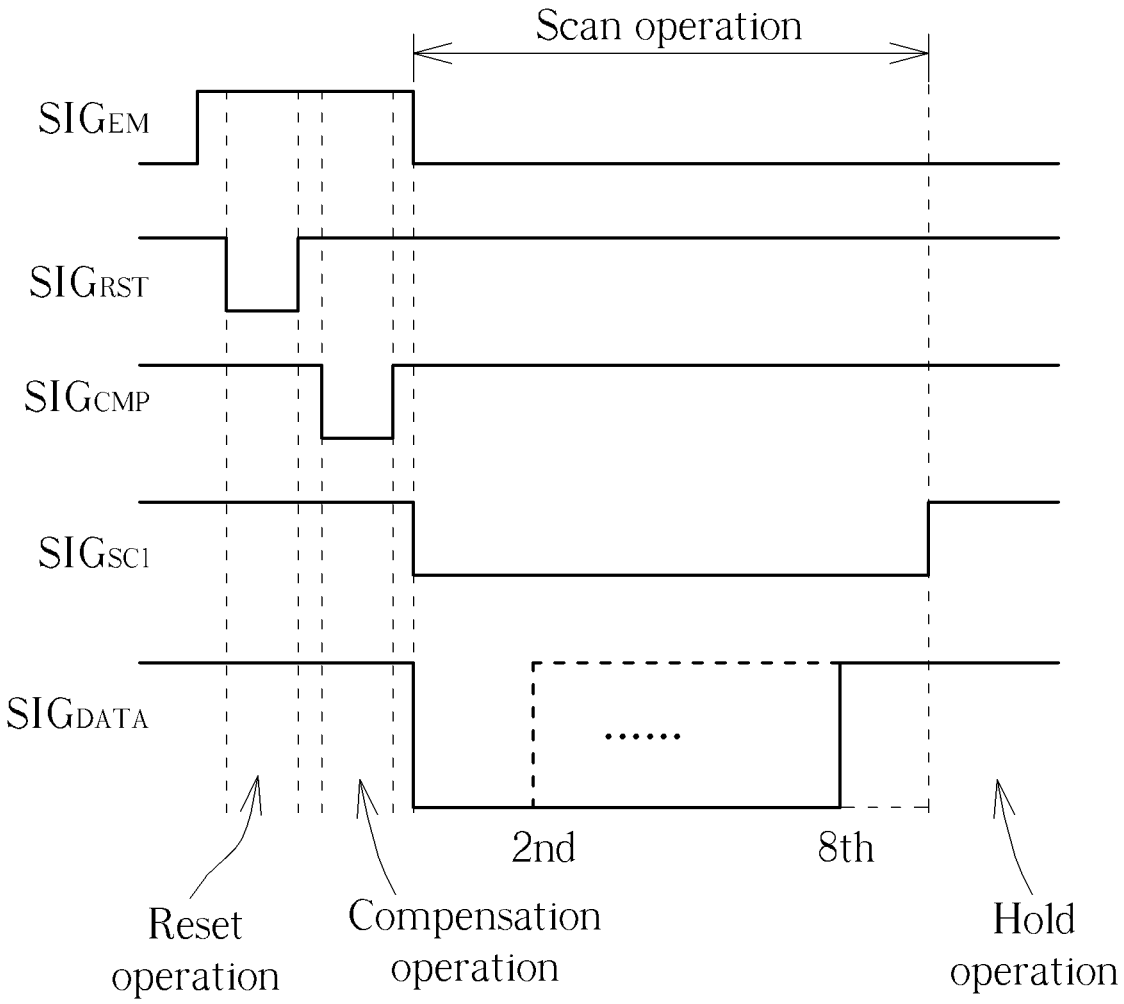
FIG. 5 shows a timing diagram for driving the pixel in FIG. 4 according to one embodiment of the present disclosure.

FIG. 5 shows a timing diagram for driving the pixel 100(1,1) according to one embodiment of the present disclosure. In FIG. 5, the driving process may include a reset operation, a compensation operation, and a scan operation.

Please refer to FIGS. 4 and 5. During the reset operation, the scan signal $SIG_{SC1}$, the emission control signal $SIG_{EM}$, and the compensation signal $SIG_{CMP}$ are at a high voltage and the scanning TFT 123, the emission control TFT 122, the compensation TFT 125 and the compensation TFT 126 are turned off. Also, the reset signal $SIG_{RST}$ is at a low voltage and the reset TFT 124 is turned on.

In this case, the control terminal of the driving TFT 121 can be reset to the reset voltage VRST, and the gate to source voltage Vgs of the driving TFT 121 can be represented as the voltage difference between the reset voltage VRST and the first voltage VDD (VRST−VDD). In some embodiments, the reset voltage VRST can be low enough to turn on the driving TFT 121. For example, but not limited to, the reset voltage VRST can be (−1V), the first voltage VDD can be 8V, and the second voltage VSS can be 0V.

During the compensation operation, the scan signal $SIG_{SC1}$, the emission control signal $SIG_{EM}$, and the reset signal $SIG_{RST}$ are at a high voltage, and the scanning TFT 123, the emission control TFT 122, and the reset TFT 124 are turned off. Also, the compensation signal $SIG_{CMP}$ is at a low voltage, and the compensation TFTs 125 and 126 are turned on.

In this case, the second terminal of the capacitor C1 would receive the reference voltage VREF, and the control terminal of the driving TFT 121 would be coupled to (VDD-|Vth|), where Vth is the threshold voltage of the driving TFT 121. In some embodiments, the reference voltage VREF can be, for example but not limited to, 4V. Consequently, the gate to source voltage Vgs of the driving TFT 121 can be represented as (−|Vth|). By involving the threshold voltage of the driving TFT 121 to the gate to source voltage Vgs, the variation of threshold voltages of the driving TFTs in different pixels can be compensated during an emission period. In one embodiment, the emission period is the period when the emission control signal $SIG_{EM}$ is at the low level to turn the emission control TFT 122 on, and the light emitting unit 110 emits light.

During the scan operation, the compensation signal $SIG_{CMP}$ and the reset signal $SIG_{RST}$ are at the high voltage, and the compensation TFT 125, the compensation TFT 126, and the reset TFT 124 are turned off. Also, the scan signal $SIG_{SC1}$ and the emission control signal $SIG_{EM}$ are at the low voltage, the scanning TFT 123 and the emission control TFT 122 are turned on, and the control terminal of the driving TFT 121 would receive the data signal $SIG_{DATA}$ on the data line DL1 through the scanning TFT 123 and the capacitor C1.

In this case, the control terminal of the driving TFT 121 would be coupled to VDD−|Vth|+(Vdata−VREF)×C1/(C1+C2), and the gate to source voltage of the driving TFT 121 would be VDD−|Vth|+(Vdata−VREF)×C1/(C1+C2)−VDD, that is, (Vdata−VREF)×C1/(C1+C2)−|Vth|, where Vdata may be the voltage applied from the data line DL1 through the scanning TFT 123 when the scanning TFT 123 on is turned on with the scan signal $SIG_{SC1}$ being at the low level. Since the gate to source voltage Vgs of the driving TFT 121 is independent of the first voltage VDD, the issue of non-uniform distribution of the first voltage VDD over the display device 10 can be reduced.

In FIG. 5, the driving circuit 120 can drive the light emitting unit 110 in the PWM mode. That is, the duty ratio of the data signal $SIG_{DATA}$ is determined according to the gray level to be represented. For example, the duty ratio of the data signal $SIG_{DATA}$ may be ranged from 70% to 90% (70%≤duty ratio≤90%, such as 75%, 80%, or 85%) to present the $8^{th}$ gray level, and the duty ratio of the data signal $SIG_{DATA}$ may be ranged from 5% to 20% (5%≤duty ratio≤20%, such as 10%, or 15%) to present the $2^{nd}$ gray level. In this case, the emission control signal $SIG_{EM}$ can be at the low voltage during the scan operation, the emission control TFT 122 is turned on, and the light emitting unit 110 can start to emit light according to the data signal $SIG_{DATA}$ during the scan operation.

However, in some embodiments, the driving circuit 120 can drive the light emitting unit 110 in the current mode when representing gray levels of higher brightness. In this case, the voltage of the data signal $SIG_{DATA}$ is determined according to the gray level to be presented. For example, when the driving TFT 121 is p-type, the voltage of the data signal $SIG_{DATA}$ that corresponds to a higher gray level would be lower than the voltage of the data signal $SIG_{DATA}$ that corresponds to a lower gray level. When the driving TFT 121 is N-type, the voltage of the data signal $SIG_{DATA}$ that corresponds to a higher gray level would be higher than the voltage of the data signal $SIG_{DATA}$ that corresponds to a lower gray level, but not limited thereto.

In some embodiments, the voltage of the data signal $SIG_{DATA}$ can be held by the capacitor C2. Therefore, the scanning TFT 123 can be turned off after the capacitor C2 has sampled the data signal $SIG_{DATA}$. For example, the pixel 100(1,1) can perform a hold operation after the scan operation. There may be a gap between the hold operation and the scan operation, but not limited thereto. During the hold operation, the scan signal $SIG_{SC1}$ can be at the high voltage and the emission control signal $SIG_{EM}$ can be at the low voltage. Therefore, the scanning TFT 123 would be turned off, the emission control TFT 122 can still be turned on, and the light emitting unit 110 can keep emitting light accordingly.

In FIG. 4, the capacitor C3 can be used to keep the voltage of the second terminal of the capacitor C1, reducing the voltage drop caused by leakage currents. However, in some embodiments, if the leakage currents caused by the TFTs are ignorable, then the capacitor C3 may be omitted, but not limited thereto. Furthermore in some embodiments, instead of coupling to the first terminal of the driving TFT 121, the first terminal of the capacitor C3 can also receive the reference voltage VREF or the reset voltage VRST.

Figure 6:
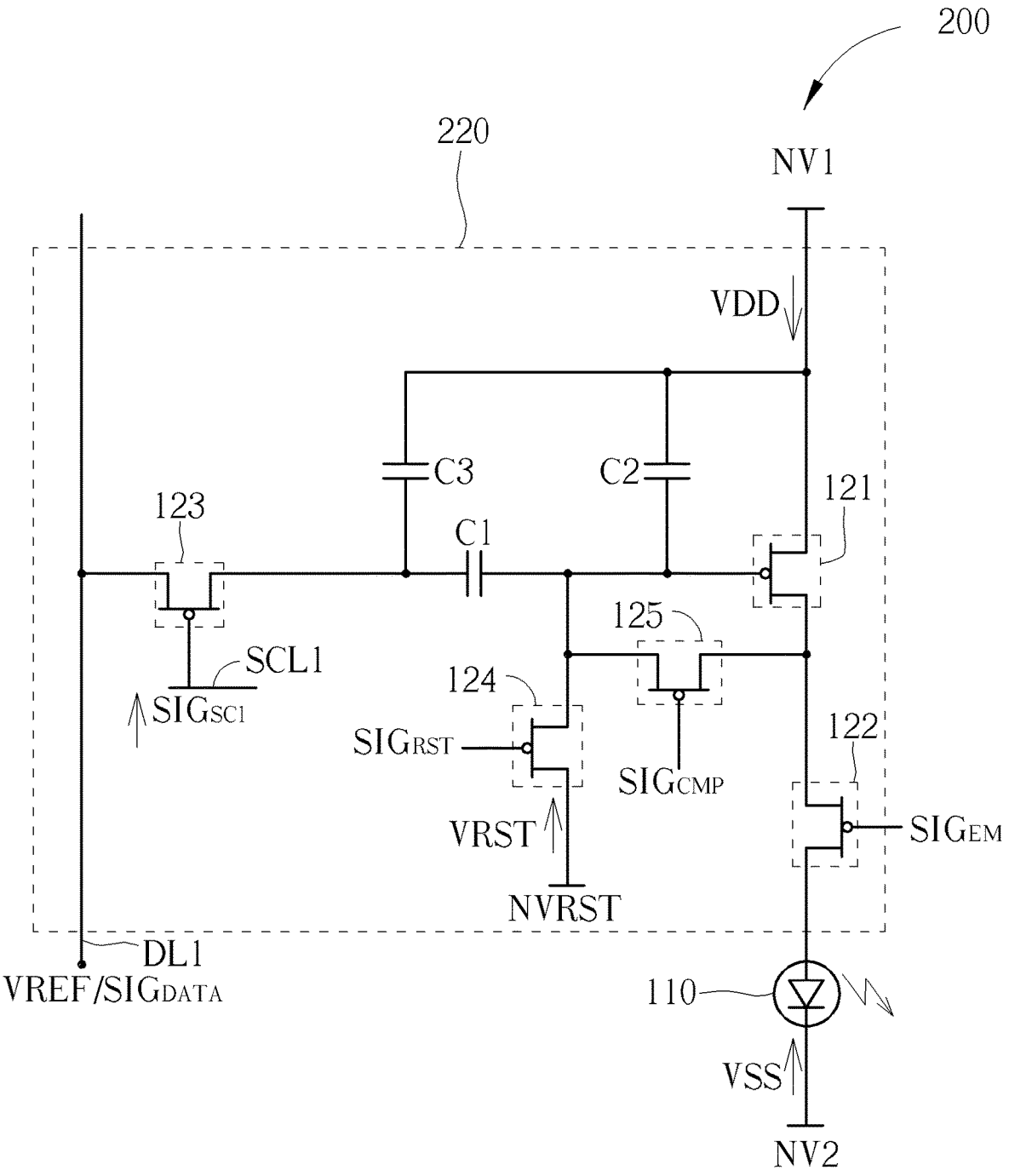
FIG. 6 shows a pixel according to another embodiment of the present disclosure.

FIG. 6 shows a pixel 200 according to one embodiment of the present disclosure. The pixel 200 and the pixel 100(1,1) have similar structures and can be operated with similar principles. In some embodiments, the pixel 200 can be used to replace at least one of the pixels 100(1,1) to 100(M,N) in the display device 10. However, the compensation TFT 126 used in driving circuit 120 of the pixel 100(1,1) can be omitted in the driving circuit 220 of the pixel 200.

Figure 7:
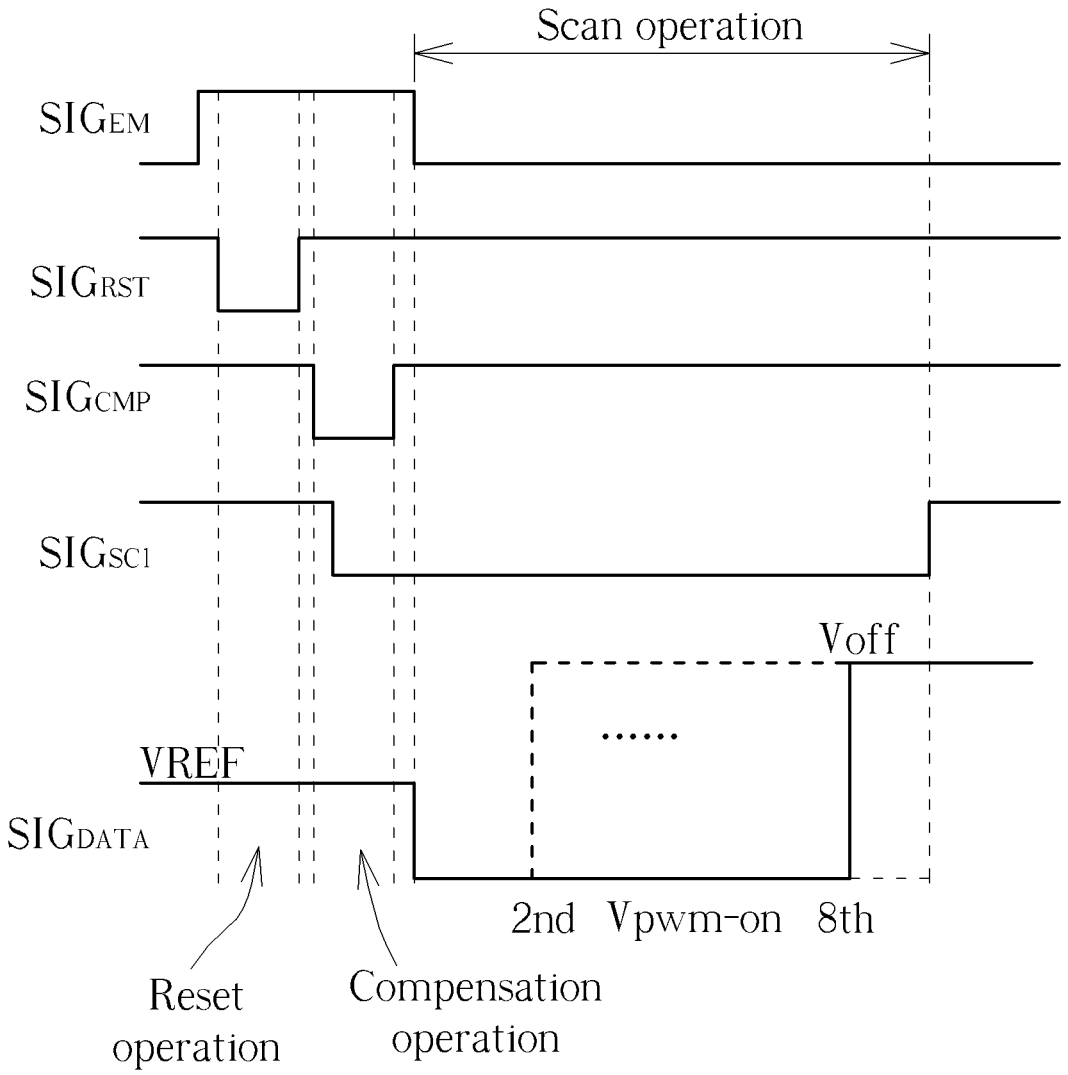
FIG. 7 shows a timing diagram for driving the pixel in FIG. 6.

FIG. 7 shows a timing diagram for driving the pixel 200 according to one embodiment of the present disclosure. In FIG. 7, the reset operation is performed with the same condition as shown in FIG. 5. However, in FIG. 7, during the compensation operation, the scan signal $SIG_{SC1}$ and the compensation signal $SIG_{CMP}$ can be at the low voltage, and the data line DL1 can be at the reference voltage VREF. Therefore, the scanning TFT 123 will be turned on, and the second terminal of the capacitor C1 can receive the reference voltage VREF through the scanning TFT 123. Consequently, the variation of threshold voltage of the driving TFT 121 can be compensated in the pixel 200 by performing the compensation operation, and other operations can be performed with the same conditions as used by the pixel 100(1,1). In some embodiments, the voltage Vpwm-on may be a voltage level that can turn on the driving TFT 121, and the voltage Vpwm-on may be optimized for PWM driving, but not limited thereto. The voltage Voff may be a voltage level that can turn off the driving TFT 121, but not limited thereto. The voltage VRST may be a voltage level that can turn on the driving TFT 121, but not limited thereto.

Figure 8:
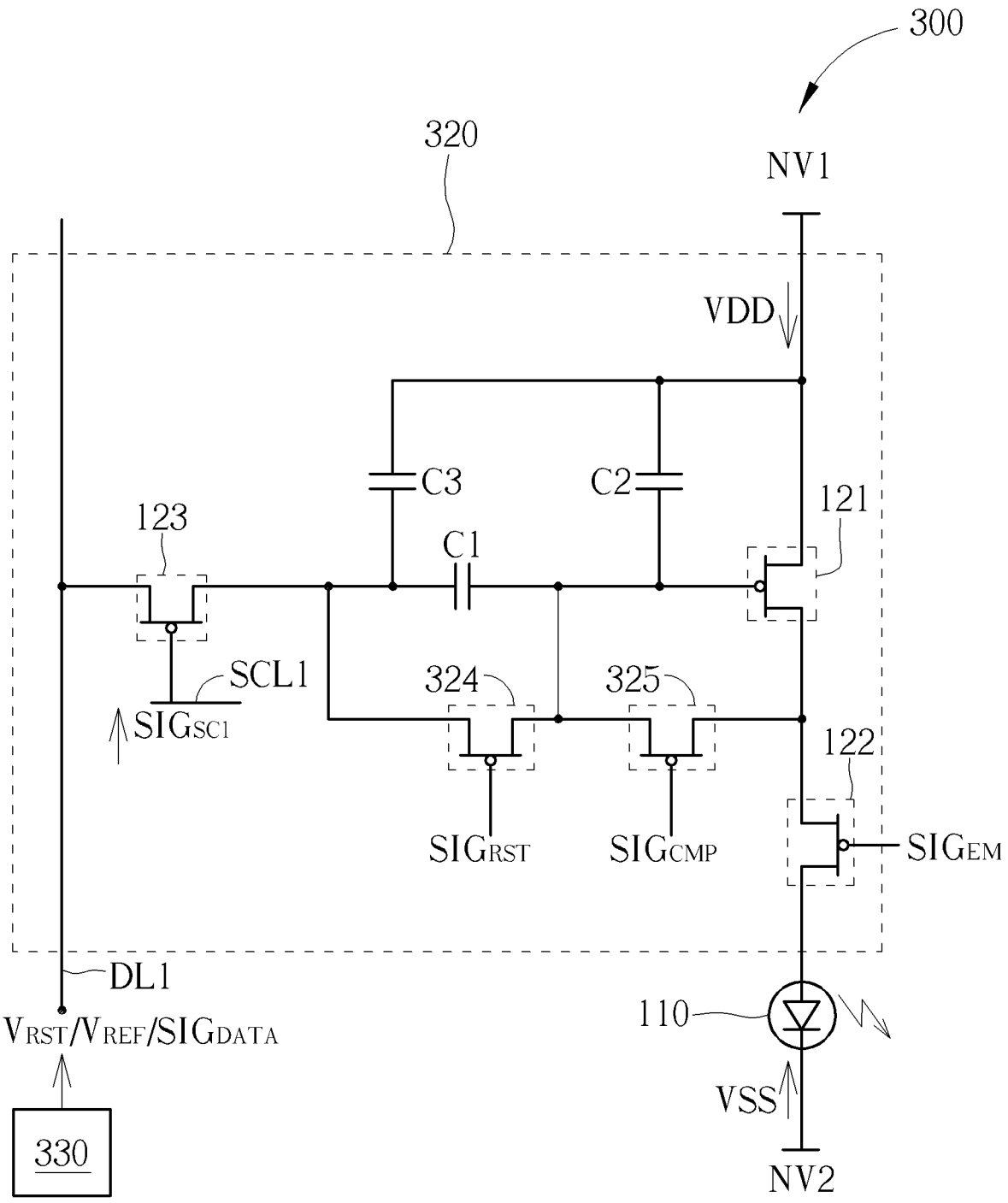
FIG. 8 shows a pixel according to another embodiment of the present disclosure.

FIG. 8 shows a pixel 300 according to one embodiment of the present disclosure. The pixel 300 and the pixel 100(1,1) have similar structures and can be operated with similar principles. In some embodiments, the pixel 300 can be used to replace at least one of the pixels 100(1,1) to 100(M,N) in the display device 10. However, the driving circuit 320 can include a reset TFT 324 and a compensation TFT 325.

The reset TFT 324 has a first terminal coupled to the second terminal of the capacitor C1, a second terminal coupled to the first terminal of the capacitor C1, and a control terminal for receiving the reset signal $SIG_{RST}$. The compensation TFT 325 has a first terminal coupled to the second terminal of the reset TFT 324, a second terminal coupled to the second terminal of the driving TFT 121, and a control terminal for receiving the compensation signal $SIG_{CMP}$.

Figure 9:
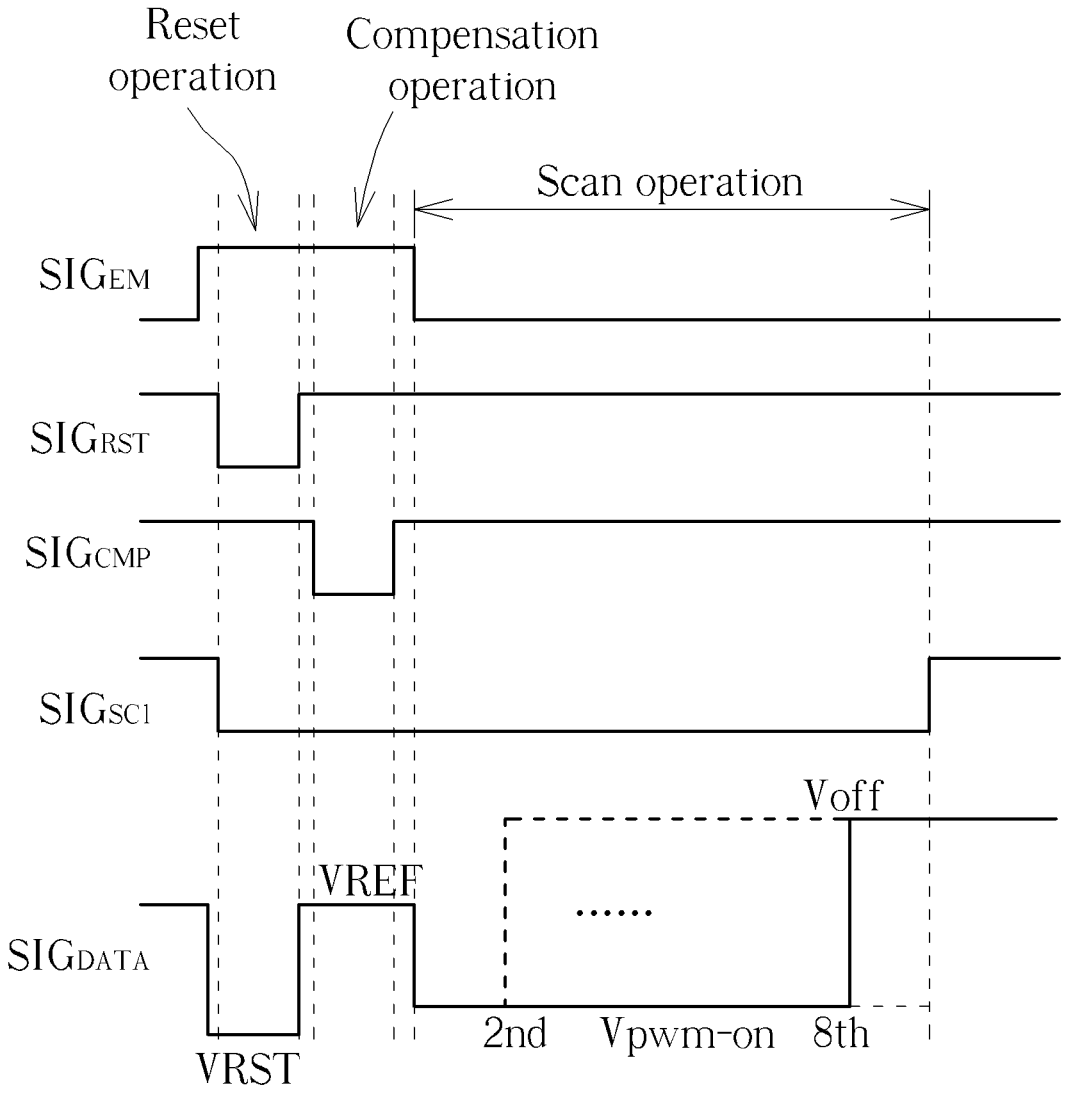
FIG. 9 shows a timing diagram for driving the pixel in FIG. 8.

FIG. 9 shows a timing diagram for driving the pixel 300 according to one embodiment of the present disclosure. In FIG. 9, during the reset operation, the scan signal $SIG_{SC1}$ can be at the low voltage, the compensation signal $SIG_{CMP}$ can be at the high voltage, and the data line DL1 can be at the reset voltage VRST. In one example, the reset voltage VRST may not correspond to the low logic voltage level, and the reference voltage VREF may not correspond to the high logic voltage level. Therefore, the compensation TFT 325 will be turned off, the scanning TFT 123 will be turned on, and the control terminal of the driving TFT 121 can receive the reset voltage VRST through the scanning TFT 123 and the reset TFT 324.

Also, during the compensation operation, the reset signal $SIG_{RST}$ can be at the high voltage, the scan signal $SIG_{SC1}$ and the compensation signal $SIG_{CMP}$ can be at the low voltage, and the data line DL1 can be at the reference voltage VREF. Therefore, the reset TFT 324 will be turned off, and the scanning TFT 123 and the compensation TFT 325 will be turned on. Therefore, the second terminal of the capacitor C1 can receive the reference voltage VREF through the scanning TFT 123.

Consequently, the pixel 300 can be implemented by fewer TFTs, and the area of the display device 10 can be reduced by adopting pixels 300. In some embodiments, the pixel 300 can be adopted by the display device 10, the display device 10 may further include a signal control circuit 330 for providing the reference voltage VREF, the reset voltage VRST, and the data signal $SIG_{DATA}$ to the data line DL1 according to the operations of the pixel 300.

Although the pixels 100(1,1) to 100(M,N), 200, and 300 are implemented with P-type transistors, the pixels of the display device can also be implemented with N-type transistors in some embodiments.

Figure 10:
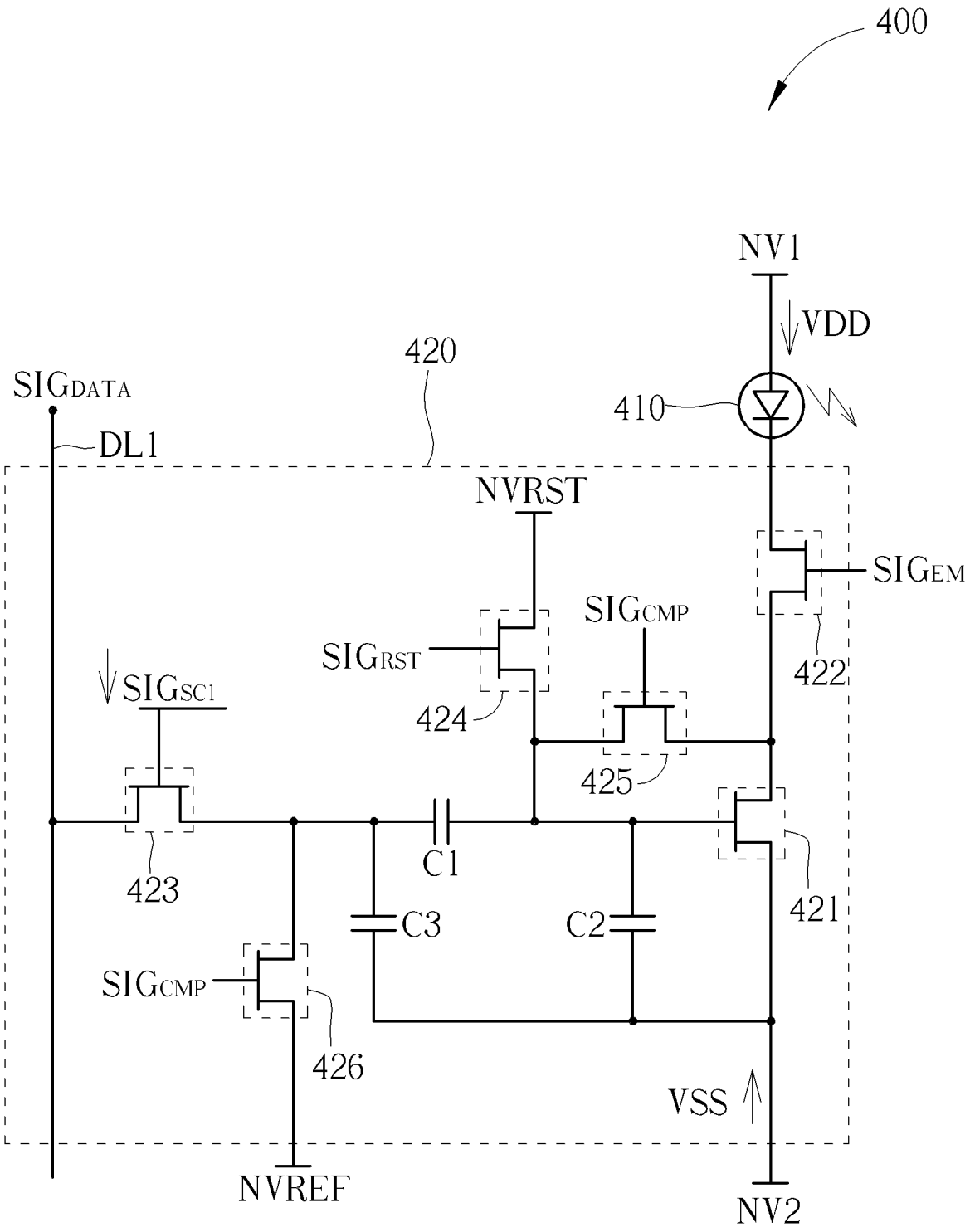
FIG. 10 shows a pixel according to another embodiment of the present disclosure.

FIG. 10 shows a pixel 400 according to one embodiment of the present disclosure. The pixel 400 and the pixel 100 have similar structures and can be operated with similar principles. In some embodiments, the pixel 400 can be used to replace the pixels 100(1,1) to 100(M,N) in the display device 10. However, the pixel 400 includes the light emitting unit 410 and the driving circuit 420.

In FIG. 10, the driving circuit 420 can include a driving thin film transistor (TFT) 421, an emission control 422, a scanning TFT 423, a reset TFT 424, compensation TFTs 425 and 426, and a capacitor C1, a capacitor C2, and a capacitor C3. Since the driving TFT 421, the emission control 422, the scanning TFT 423, the reset TFT 424, the compensation TFT 425 and the compensation TFT 426 are N-type transistors, the waveforms of the scan signal $SIG_{SC1}$, the reset control signal $SIG_{RST}$, the compensation signal $SIG_{CMP}$, and the emission control signal $SIG_{EM}$ used to perform the reset operation, the compensation operation, and the scan operation as shown in FIG. 5 would be inversed when applying to the driving circuit 420.

In some embodiments, to perform the reset operation and the compensation operation, the reference voltage VREF applied to the driving circuit 420 can be 1V, and the reset voltage VRST applied to the driving circuit 420 can be 9V in case that the first voltage VDD is 8V and the second voltage VSS is 0V. In other embodiments, the reference voltage VREF may be ranged from 0.5V to 2V (0.5V≤VREF≤2V), and the reset voltage VRST may be ranged from 6V to 12V (6V≤VREF≤12V), such as 8V or 10V, but not limited thereto.

In summary, the display device provided by the embodiments of the present disclosure can drive the pixels in both current mode and PWM mode according to the gray level to be presented. That is, the driving circuit of the pixel can drive the light emitting unit in a PWM mode to present a gray level of low brightness to reduce color shift, and can drive the light emitting unit in a current mode to present a gray level of high brightness to deliver a better power efficiency.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A display device, comprising:

a plurality of pixels, at least one of the plurality of pixels comprising a light emitting unit and a driving circuit;

wherein to present a first gray level lower than or equal to a predetermined gray level, the driving circuit is configured to drive the light emitting unit in a pulse width modulation (PWM) mode, and to present a second gray level higher than the predetermined gray level, the driving circuit is configured to drive the light emitting unit in a current mode;

wherein the driving circuit comprises:

a driving thin film transistor (TFT) having a first terminal coupled to a first voltage terminal, a second terminal coupled to the light emitting unit, and a control terminal; and a scanning TFT having a first terminal coupled to a data line, a second terminal coupled to the control terminal of the driving TFT, and a control terminal configured to receive a scan signal;

wherein during a scan operation, the scanning TFT is turned on, and the control terminal of the driving TFT receives a data signal on the data line through the scanning TFT.

2. The display device of claim 1, wherein a driving current generated by the driving circuit in the PWM mode has a duty ratio less than 100%.

3. The display device of claim 1, wherein in the current mode, the light emitting unit is driven with a variable driving current.

4. The display device of claim 1, wherein the driving circuit comprises a second capacitor having a first terminal coupled to the first terminal of the driving TFT, and a second terminal coupled to the control terminal of the driving TFT.

5. The display device of claim 1, wherein during the scan operation when the driving circuit drives the light emitting unit in the PWM mode to present the first gray level:

a duty ratio of the data signal is determined according to the first gray level.

6. The display device of claim 1, wherein after the scan operation, during a hold operation when the driving circuit drives the light emitting unit in the current mode to present the second gray level:

the scanning TFT is turned off; and a voltage of the data signal is determined according to the second gray level.

7. The display device of claim 1, wherein the driving circuit further comprises:

an emission control TFT coupled between the driving TFT and the light emitting unit, and the emission control TFT having a first terminal coupled to the second terminal of the driving TFT, a second terminal coupled to the light emitting unit, and a control terminal configured to receive an emission control signal; and a first capacitor coupled between the control terminal of the driving TFT and the second terminal of the scanning TFT, and the first capacitor having a first terminal coupled to the control terminal of the driving TFT, and a second terminal coupled to the second terminal of the scanning TFT.

8. The display device of claim 7, wherein the driving circuit further comprises:

a reset TFT having a first terminal coupled to the control terminal of the driving TFT, a second terminal coupled to a reset voltage terminal, and a control terminal configured to receive a reset signal.

9. The display device of claim 8, wherein during a reset operation:

the scanning TFT is turned off; and the reset TFT is turned on.

10. The display device of claim 8, wherein the driving circuit further comprises:

a first compensation TFT having a first terminal coupled to the first terminal of the reset TFT, a second terminal coupled to the second terminal of the driving TFT, and a control terminal configure to receive a compensation signal.

11. The display device of claim 10, wherein during a compensation operation:

the scanning TFT and the first compensation TFT are turned on; and the data line is coupled to a reference voltage terminal.

12. The display device of claim 10, wherein the driving circuit further comprises:

a second compensation TFT having a first terminal coupled to the second terminal of the first capacitor, a second terminal coupled to a reference voltage terminal, and a control terminal configure to receive the compensation signal.

13. The display device of claim 12, wherein during a compensation operation:

the scanning TFT is turned off; and the first compensation TFT and the second compensation TFT are turned on.

14. The display device of claim 7, wherein the driving circuit further comprises:

a reset TFT having a first terminal coupled to the second terminal of the first capacitor, a second terminal coupled to the first terminal of the first capacitor, and a control terminal configured to receive a reset signal; and a compensation TFT having a first terminal coupled to the second terminal of the reset TFT, a second terminal coupled to the second terminal of the driving TFT, and a control terminal configured to receive a compensation signal.

15. The display device of claim 14, wherein during a reset operation:

the scanning TFT and the reset TFT are turned on;

the compensation TFT is turned off; and the data line is coupled to a reset voltage terminal.

16. The display device of claim 14, wherein during a compensation operation:

the scanning TFT and the compensation TFT are turned on; and the reset TFT is turned off; and the data line is coupled to a reference voltage terminal.

17. The display device of claim 7, wherein the driving circuit further comprises:

a third capacitor having a first terminal coupled to the first terminal of the driving TFT, and a second terminal coupled to the second terminal of the first capacitor.

18. The display device of claim 1, further comprising:

a signal control circuit configured to provide a reference voltage, a reset voltage, or a data signal according to an operation of the pixel.

* * * * *